US008661715B2

(12) United States Patent
Roth

(10) Patent No.: US 8,661,715 B2
(45) Date of Patent: Mar. 4, 2014

(54) RECONFIGURABLE FOOTWEAR

(76) Inventor: Karen Q. Roth, West Palm Beach, FL (US)

( * ) Notice: Subject to any disclaimer, the term of this patent is extended or adjusted under 35 U.S.C. 154(b) by 293 days.

(21) Appl. No.: 13/012,524

(22) Filed: Jan. 24, 2011

(65) Prior Publication Data

US 2011/0179671 A1 Jul. 28, 2011

Related U.S. Application Data

(60) Provisional application No. 61/336,618, filed on Jan. 25, 2010.

(51) Int. Cl.
*A43B 3/24* (2006.01)

(52) U.S. Cl.
USPC ..... 36/101; 36/11.5; 36/100

(58) Field of Classification Search
USPC ..... 36/11.5, 101, 100, 15
See application file for complete search history.

(56) References Cited

U.S. PATENT DOCUMENTS

| | | | | | |
|---|---|---|---|---|---|
| 2,469,708 | A * | 5/1949 | Alexander | 36/11.5 |
| 2,526,940 | A * | 10/1950 | Fello | 36/11.5 |
| 2,976,623 | A * | 3/1961 | Gallaway | 36/11.5 |
| 3,925,915 | A * | 12/1975 | Colli | 36/11.5 |
| 4,450,633 | A * | 5/1984 | Connelly | 36/101 |
| 4,461,102 | A * | 7/1984 | DeVincentis | 36/101 |
| 5,896,684 | A * | 4/1999 | Lin | 36/101 |
| 5,992,058 | A * | 11/1999 | Jneid | 36/100 |
| 6,128,834 | A * | 10/2000 | Vecchiola et al. | 36/11.5 |
| 6,237,250 | B1 * | 5/2001 | Aguerre | 36/11.5 |
| 6,430,846 | B1 * | 8/2002 | Lin | 36/101 |
| 6,442,870 | B1 * | 9/2002 | Tsai | 36/11.5 |
| 6,499,234 | B2 * | 12/2002 | Manzi | 36/100 |
| 6,637,130 | B2 * | 10/2003 | Urie et al. | 36/11.5 |
| 6,694,641 | B1 * | 2/2004 | Gill | 36/11.5 |
| 7,272,899 | B1 * | 9/2007 | Marak | 36/101 |
| 7,347,010 | B2 * | 3/2008 | Yu | 36/11.5 |
| 8,020,319 | B1 * | 9/2011 | Mohaupt | 36/101 |
| 8,201,347 | B2 * | 6/2012 | Garza | 36/101 |
| 8,250,780 | B1 * | 8/2012 | Diaz | 36/11.5 |
| 2002/0174569 | A1 * | 11/2002 | Tsai | 36/101 |
| 2004/0128859 | A1 * | 7/2004 | Cambronero | 36/11.5 |
| 2004/0187346 | A1 * | 9/2004 | Bianchi et al. | 36/11.5 |
| 2006/0026861 | A1 * | 2/2006 | Manzi | 36/11.5 |
| 2006/0059720 | A1 * | 3/2006 | Phelan | 36/101 |
| 2006/0112597 | A1 * | 6/2006 | Stern et al. | 36/101 |
| 2006/0174514 | A1 * | 8/2006 | Scozzafava et al. | 36/11.5 |
| 2007/0240336 | A1 * | 10/2007 | Richardson | 36/101 |
| 2007/0261267 | A1 * | 11/2007 | Osborn | 36/15 |
| 2009/0133289 | A1 * | 5/2009 | Cantoni | 36/101 |
| 2009/0217550 | A1 * | 9/2009 | Koo | 36/91 |

(Continued)

OTHER PUBLICATIONS

Interchangeable Flip Flops—Downloaded from web site http://www.lindsay-phillips.com/switch-flops.aspx on Mar. 10, 2011.

*Primary Examiner* — Khoa Huynh
*Assistant Examiner* — Katharine Gracz

(57) ABSTRACT

An article of footwear has hooks which may be attached to the inner and outer peripheral edge of the sole (e.g., two or more on each side) to secure different strap or upper covering options. The footwear (shoe/sandal) is only functional when the straps/upper covering are attached to the sole of the shoe/sandal via the hooks. The design of the hook provides a securing method to removably connect the straps to the sole of the shoe/sandal.

2 Claims, 5 Drawing Sheets

(56) References Cited

U.S. PATENT DOCUMENTS

| | | | | |
|---|---|---|---|---|
| 2009/0293312 | A1* | 12/2009 | Scozzafava | 36/101 |
| 2010/0037486 | A1* | 2/2010 | Verheijen | 36/101 |
| 2010/0037487 | A1* | 2/2010 | Connett | 36/103 |
| 2010/0083533 | A1* | 4/2010 | Terner et al. | 36/43 |
| 2010/0223812 | A1* | 9/2010 | Batanero Bastida | 36/100 |
| 2010/0275462 | A1* | 11/2010 | Pucci | 36/102 |
| 2012/0079738 | A1* | 4/2012 | Alberi | 36/11.5 |

* cited by examiner

RECONFIGURABLE FOOTWEAR

CROSS-REFERENCE TO RELATED APPLICATIONS

This application claims benefit of U.S. provisional patent application Ser. No. 61/336,618, filed Jan. 25, 2010, which is herein incorporated by reference.

FIELD

Embodiments of the present invention generally relate to footwear.

BACKGROUND

People like to wear a variety of footwear. However, purchasing a large number of shoes can become quite expensive. Moreover, storing a large number of shoes requires a lot of storage space.

SUMMARY

Methods and apparatus for providing reconfigurable footwear are provided herein. In some embodiments, an article of footwear may include a sole having an upper surface to support a foot of a user; a plurality of hooks coupled to the sole on either side of the upper surface; and one or more straps having a first end and an opposing second end, each strap having an opening at each end of the strap to receive a respective one of the hooks to removably secure the strap to the sole.

In some embodiments, a kit containing an article of footwear may be provided and may include a pair of soles, each sole having an upper surface to support a foot of a user; a plurality of hooks coupled to each sole on either side of the upper surface; and a plurality of pairs of straps, each strap having an opening at each end to receive a respective one of the hooks to removably secure the strap to the sole, wherein each pair of straps has one or more of the same length, the same material, the same color, the same pattern, or the same ornamentation.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
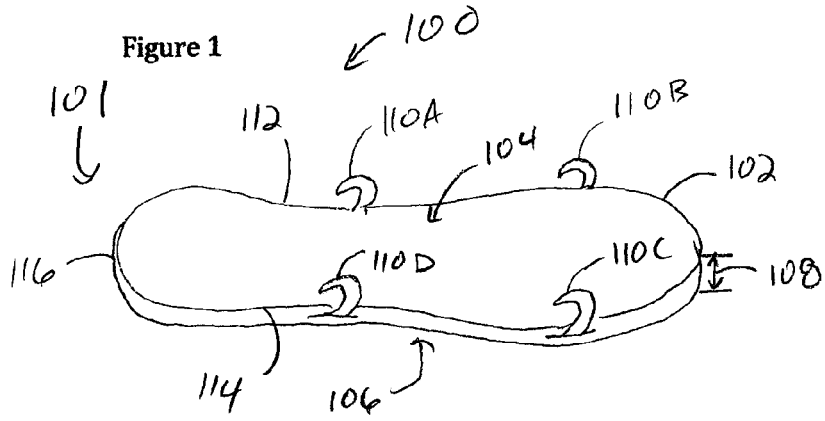
FIG. 1 is a partial perspective view of an article of footwear in accordance with some embodiments of the present invention.
Figure 2:
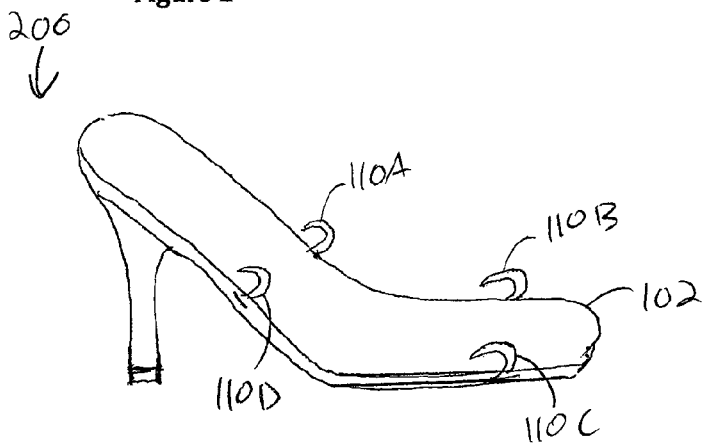
FIG. 2 is a partial perspective view of an article of footwear in accordance with some embodiments of the present invention.
Figure 3:
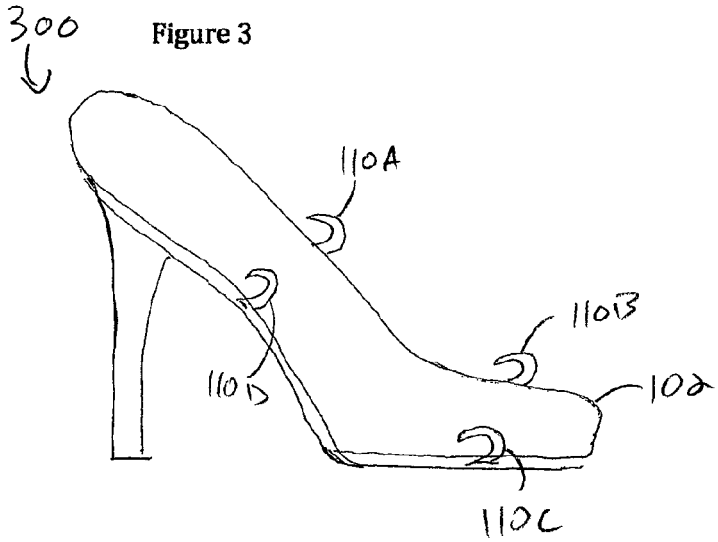
FIG. 3 is a partial perspective view of an article of footwear in accordance with some embodiments of the present invention.
Figure 4:
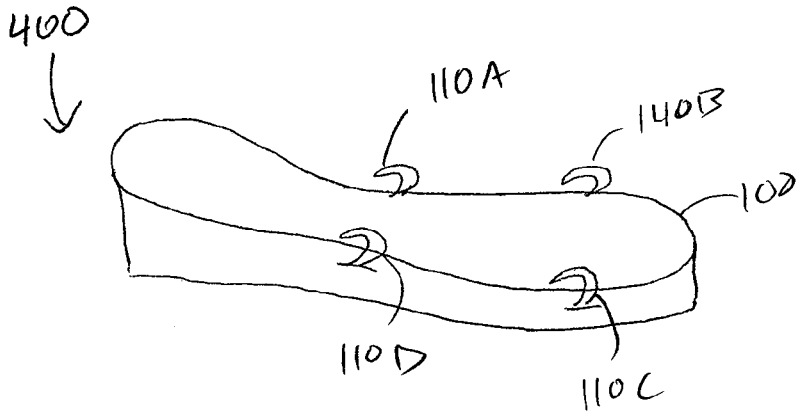
FIG. 4 is a partial perspective view of an article of footwear in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

The present invention is an item of footwear that includes a sole having hooks for removably mounting straps or foot coverings to the sole. The straps may be changed to alter the appearance and style of the shoe. The hooks may be mounted permanently along the inner and outer peripheral edges of the sole. The unique design of the hook provides a secure method to connect the straps (FIGS. 1-4) or upper covering to the sole.

The sole 102 can have any general shape including an upper surface 104 that supports the foot of the user and an opposing lower surface 106 that is in contact with the ground when worn. The upper surface 104 can be flat or contoured and the thickness 108 of the sole 102 can be any suitable thickness 108 for footwear. For example, the sole 102 can be provided in a flat 101 (FIG. 1), a low heel 200 (FIG. 2), a high heel 300 (FIG. 3), or a platform/wedge 400 (FIGS. 4) configuration. The sole 102 can be made out of any suitable material or materials typically used to manufacture footwear. The sole 102 can be made out of a single layer of material, or a number of layers of material. For example, in some embodiments, the sole 102 may have two layers, a bottom layer (for example, made of leather or other suitable wear-resistant and/or supportive material) having a top layer disposed atop the bottom layer (for example, made of foam or other suitable cushioning material).

Figure 6:
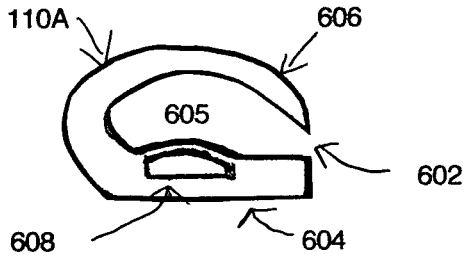
FIG. 6 is a schematic side view of a hook for an article of footwear in accordance with some embodiments of the present invention.
Figure 7:
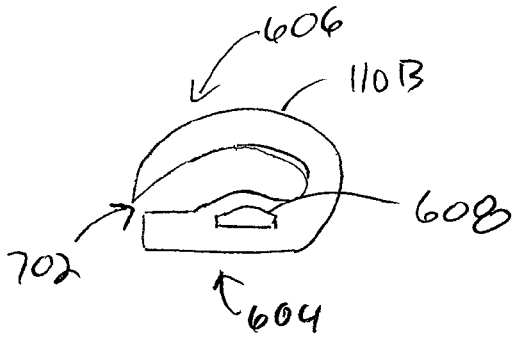
FIG. 7 is a schematic side view of a hook for an article of footwear in accordance with some embodiments of the present invention.

The function of the hooks 110A-D(a first pair of hooks being 110C & 110B and a second pair of hooks being 110A & 110D)is to secure the straps 500A-B(500B is a front strap and 500A is a back strap)to the sole 102 of the shoe 100. The hooks 110A-D may be made of any materials suitable to withstand the forces of use, such as when worn. Examples of suitable materials include metals and metal alloys. The left hook 110A (FIG. 6) is located on the left side 112 of the shoe 100 and the right hook 110B (FIG. 7) is located on the right side 114 of the shoe 100, with the open end or gap 602, 702 of each hook facing a the back heel area 116 of the shoe 100.

Figure 8:
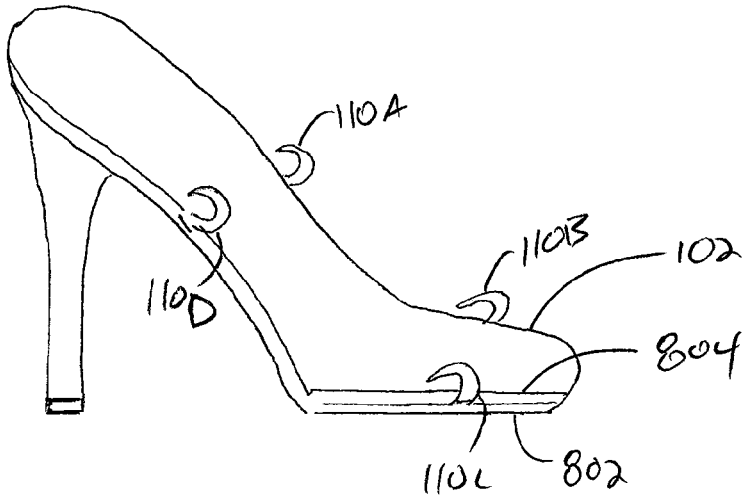
FIG. 8 is a partial perspective view of an article of footwear in accordance with some embodiments of the present invention.
Figure 9:
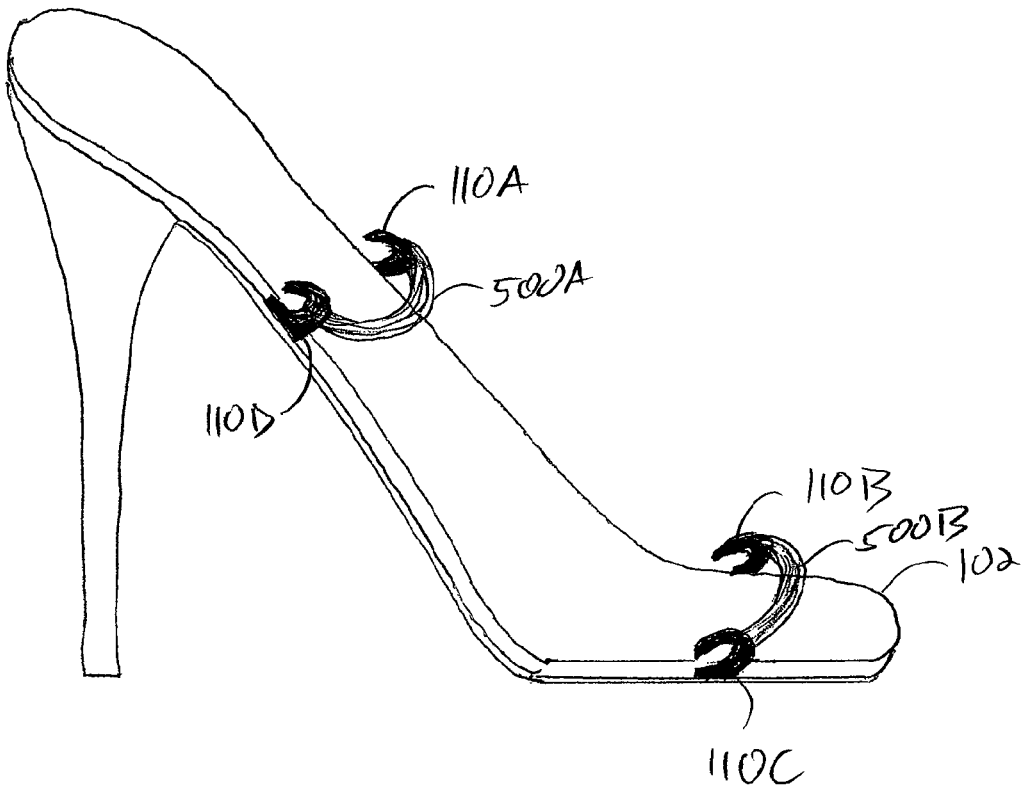
FIG. 9 is a partial perspective view of an article of footwear in accordance with some embodiments of the present invention.

The hooks 110A-D may have a lower straight anchoring portion 604 having a first free end and an curved upper open portion 606 having a second free end and a loop 605. The hook 110A-D may have a slot 608 disposed in the anchoring portion 604 that allows the hook 110A-D to be secured to the sole 102. In some embodiments, a strip of flexible material is wrapped around the hook, through the slot, and secured between two of the plurality of layers of the sole. For example, a piece of leather or material can be inserted through the slot 608 and anchored, for example, between two layers 802, 804 of the sole 102 of the shoe 100 (FIG. 8). In some embodiments, the sole comprises a plurality of layers and each hook is secured to the sole between two of the plurality of layers, wherein the hook comprises a slot and wherein a strip of flexible material is wrapped around the hook, through the slot, and secured between two of the plurality of layers of the sole, and wherein the plurality of hooks is four hooks, arranged two per side of the upper surface of the sole. The upper open portion 606 facilitates receiving the straps 500A-B and securing the straps 500A-B to the sole 102. For example, the hooks 110A-D are inserted through the holes 502 at the ends of each strap 500A-B, which secure the straps 500A-B to the sole 102 of the shoe 100 (FIG. 9).

Figure 5:
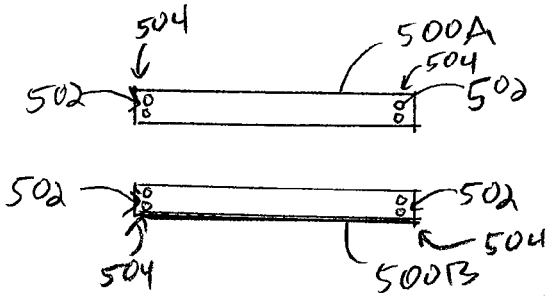
FIG. 5 is a schematic top view of straps for an article of footwear in accordance with some embodiments of the present invention.

The one or more straps 500A-B or upper covering have holes 502 at each end 504 to fasten the straps 500A-B to each hook 110A-D. The straps 500A-B (FIG. 5) fit across the wearer's upper foot, for example, extending from the inner sole, over the upper foot to the outer sole. In some embodiments, one strap 500A-B can be located at a front toe area and the other located in front ankle area. The footwear can have more hooks 110A-D thus more straps 500A-B which will provide a different fit and appearance. The straps 500A-B can be provided in a variety of colors, sizes, and materials (such as leather, fabric, rubber, polymers, combinations thereof, or the like).

In some embodiments, the customizable footwear (e.g., the shoe 100) may be provided in a kit. For example, a kit containing an article of footwear may include a pair of soles 102, each sole 102 having an upper surface 104 to support a foot of a user. Each sole 102 may be as described above. A plurality of hooks 110A-D may be coupled to each sole 102 on either side 112, 114 of the upper surface 104 as described above. A plurality of pairs of straps 500A-B may be provided. Each strap 500A-B can have an opening 502 to receive an end of one of the hooks 110A-D to be removably secured to the sole 102 as described above. Each pair of straps 500A-B may have one or more of the same length, the same material, the same color, the same pattern, or the same ornamentation, or the like such that the pairs of straps 500A-B correspond to a pair of shoes 100. As used herein, a pair of straps 500A-B is meant to include pairs of a set of straps 500A-B when a plurality of straps 500A-B (e.g., a set of straps) is used on one of the soles 102, and a corresponding set of straps 500A-B is required for the other sole 102 of the pair. Of course additional pairs of straps 500A-B or pairs of strap sets may be provided to give the user flexibility in the design, appearance, fit, etc. of the customizable footwear.

Thus, customizable footwear has been provided. The customizable footwear includes functional and fashionable custom hooks, which accommodate a variety of straps. By providing numerous soles ranging from flat to a variety of heels, wedge or platform, etc., and providing a plurality of hooks which couple the straps to the soles, allows individualized styling and customization of the footwear by the wearer. As the customizable footwear can be configured in a variety of styles by merely changing the straps or upper cover, a large number of styles may be available to the wearer without purchasing additional shoes and without taking up a large amount of space for storage. In addition, as many styles can be provided without taking up a lot of storage space, the customizable footwear may also be beneficial while traveling, where luggage space may be limited.

While the foregoing is directed to embodiments of the present invention, other and further embodiments of the invention may be devised without departing from the basic scope thereof.

The invention claimed is:

1. A shoe consisting of:

a) a sole having a length defined by a back heel area and a front toe area, a width defined by a lateral edge and a medial edge, an upper surface adapted to support a wear's foot and an opposing lower surface adapted to engage a ground surface when the shoe is worn; wherein the sole has a predetermined constant thickness along the entire length and width; wherein the lower surface of the sole has a bottom layer made from a wear-resistant material adapted to engage the ground surface and the upper surface of the sole has a top layer made from cushioning material;

b) only two pairs of hooks, a first pair of hooks is mounted permanently along the medial and lateral edges in the front toe area of the wearer's foot and a second pair of hooks is mounted permanently along the medial and lateral edges in a front ankle area of the back heel area of the wearer's foot;

wherein each pair of the first and second pair of hooks is sandwiched in between the top layer and bottom layer;

each hook has a lower straight anchoring portion having a first free end, a curved upper portion integrally formed with the lower straight anchoring portion, the curved upper portion has a second free end, a gap formed between the first free end of the lower straight portion and the second free end of the curved upper portion; each of the hooks further includes a loop and a slot; the slot is disposed in the lower straight anchoring portion, wherein the straight anchoring portion in conjunction with the slot allowing each of the hooks to be permanently sandwiched to the sole in between the two layers such that the second free end of the curved upper portion is facing the back heel area of the sole allowing straps to be received through the gap and into the loop; and c) a front strap disposed at the front toe area and a back strap disposed at the front ankle area of the back heel area, each of the straps having two holes adjacent to each other at each end of each strap; wherein the front strap is fastened to the first pair of hooks through the two holes disposed on each end of the front strap and the back strap is fastened to the second pair of hooks through the two holes disposed on each end of the back strap; wherein the front strap is designed to only extend across laterally the wearer's foot in the toe area; and the back strap is designed to only extend across laterally an ankle of the wearer's foot in the front ankle area.

2. The shoe of claim 1, wherein the straps are designed to range in a variety of colors, sizes, and material, wherein the straps can be one of a same length, a same color, a same pattern, or a same orientation; wherein the sole can be a flat, a low heel, a high heel or a platform/wedge configuration.

* * * * *